US010581210B2

(12) United States Patent
Pogash et al.

(10) Patent No.: US 10,581,210 B2
(45) Date of Patent: Mar. 3, 2020

(54) RECEPTACLE ASSEMBLY HAVING CABLED RECEPTACLE CONNECTORS

(71) Applicant: TE CONNECTIVITY CORPORATION, Berwyn, PA (US)

(72) Inventors: Christopher Michael Pogash, Harrisburg, PA (US); Dustin Grant Rowe, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/048,578

(22) Filed: Jul. 30, 2018

(65) Prior Publication Data

US 2020/0036142 A1 Jan. 30, 2020

(51) Int. Cl.

| | |
|---|---|
| ***H01R 13/74*** | (2006.01) |
| ***H01R 25/00*** | (2006.01) |
| ***H01R 13/659*** | (2011.01) |

(52) U.S. Cl.

CPC ..... *H01R 13/74* (2013.01); *H01R 25/006* (2013.01); *H01R 13/659* (2013.01); *H01R 2201/04* (2013.01)

(58) Field of Classification Search

CPC .. H01R 13/516; H01R 13/518; H01R 13/658; H01R 13/6581; H01R 13/659; H01R 13/6594; H01R 13/74; H01R 25/006; H01R 2201/04

See application file for complete search history.

(56) References Cited

U.S. PATENT DOCUMENTS

| | | | | |
|---|---|---|---|---|
| 5,299,942 | A * | 4/1994 | Burke | H01R 13/6485 439/79 |
| 5,767,999 | A * | 6/1998 | Kayner | G06F 13/409 398/164 |
| 6,443,768 | B1 | 9/2002 | Dirkers et al. | |
| 6,469,905 | B1 * | 10/2002 | Hwang | G02B 6/4277 361/756 |
| 6,508,670 | B1 * | 1/2003 | Hwang | H01R 13/6594 439/607.37 |
| 6,511,345 | B1 * | 1/2003 | Hwang | H01R 12/707 439/541.5 |
| 6,866,544 | B1 * | 3/2005 | Casey | H05K 9/0058 439/607.2 |
| 6,872,094 | B1 | 3/2005 | Murr et al. | |
| 7,387,517 | B2 | 6/2008 | Kusuda et al. | |
| 7,566,244 | B1 * | 7/2009 | Nguyen | G02B 6/4201 439/607.2 |
| 8,613,632 | B1 * | 12/2013 | Nichols | H01R 13/6587 439/485 |
| 9,011,177 | B2 | 4/2015 | Lloyd et al. | |

(Continued)

*Primary Examiner* — Oscar C Jimenez

(57) ABSTRACT

A receptacle assembly includes a receptacle cage having walls defining a cavity extending between a front and a rear and having a module channel receiving a pluggable module. The walls include a top wall, a bottom wall and first and second sidewalls extending from the top wall to the bottom wall. The cavity is open at the rear to receive a cabled receptacle connector in the module channel and the cavity is open at the front to receive the pluggable module therein. A mounting panel extends from the bottom wall and has a mounting surface below the bottom wall for supporting the bottom wall of the receptacle cage at an elevated position above the mounting surface.

20 Claims, 4 Drawing Sheets

(56) References Cited

U.S. PATENT DOCUMENTS

| | | | | |
|---|---|---|---|---|
| 9,666,993 | B2 * | 5/2017 | Long | H01R 13/6581 |
| 9,763,570 | B2 | 6/2017 | Briant et al. | |
| 10,114,182 | B2 * | 10/2018 | Zbinden | G02B 6/4268 |
| 10,243,305 | B1 * | 3/2019 | Pan | H01R 13/665 |
| 2002/0197043 | A1 * | 12/2002 | Hwang | H01R 13/659<br>385/134 |
| 2013/0072062 | A1 * | 3/2013 | Regnier | H01R 9/038<br>439/607.01 |
| 2014/0094043 | A1 * | 4/2014 | Myer | H01R 12/7029<br>439/83 |
| 2015/0357758 | A1 * | 12/2015 | Krietzman | H01R 13/639<br>439/345 |
| 2016/0218455 | A1 * | 7/2016 | Sayre | H01R 13/6594 |
| 2016/0353563 | A1 * | 12/2016 | Morimoto | H05K 5/0026 |
| 2017/0040745 | A1 * | 2/2017 | Phillips | H01R 13/6581 |
| 2017/0264052 | A1 * | 9/2017 | Henry | H01R 13/518 |
| 2018/0120906 | A1 | 5/2018 | Reed et al. | |
| 2018/0366890 | A1 | 12/2018 | Lloyd et al. | |

* cited by examiner

RECEPTACLE ASSEMBLY HAVING CABLED RECEPTACLE CONNECTORS

BACKGROUND OF THE INVENTION

The subject matter herein relates generally to communication systems having receptacle assemblies including cabled receptacle connectors in receptacle cages.

Communication systems are known having receptacle cages mounted to host circuit boards. The communication systems typically include a board mounted receptacle connector mounted directly to the host circuit board within a receptacle cage. The receptacle connector has contacts including mating ends defining a mating interface for mating with pluggable modules and terminating ends that are terminated directly to the host circuit board. Signal paths are defined from the pluggable modules to the host circuit board through the signal contacts of the receptacle connectors. However, the signal paths are routed through the host circuit board and may be long signal paths along the host circuit board, leading to signal loss along the long signal paths. Additionally, the geometries of the systems are limited due to being mounted to the surface of the host circuit board. Stacking and ganging of multiple receptacle cages within the communication system is limited due to space needed for mounting the multiple receptacle cages adjacent each other on the host circuit board and to the front panel or bezel, leading to a decrease in density of the communication system within a given space or envelope. Additionally, with stacked receptacle connectors, the signal contacts associated with the upper module channel mated with the upper pluggable module have longer signal path lengths than the signal contacts associated with the lower module channel mated with the lower pluggable module leading to problems with electrical skew. Furthermore, the board mounted receptacle cages and receptacle connectors have problems with cooling of the components due to a lack of airflow around the components, such as between the host circuit board and the components.

Some known communication systems utilize receptacle connectors having cables terminated to the signal contacts rather than terminating the signal contacts directly to a host circuit board. However, incorporating such cabled receptacle connectors into a receptacle cage is problematic. Removal and/or replacement of such cabled receptacle connectors is problematic.

A need remains for a receptacle cage for a communication system that removably receives cabled receptacle connectors.

BRIEF DESCRIPTION OF THE INVENTION

In one embodiment, a receptacle assembly of a communication system is provided including a receptacle cage having a plurality of walls defining a cavity extending between a front and a rear of the receptacle cage. The cavity includes a module channel configured to receive a pluggable module. The plurality of walls include a top wall, a bottom wall, a first side wall extending from the top wall to the bottom wall, and a second side wall extending from the top wall to the bottom wall. The cavity is open at the rear to receive a cabled receptacle connector in the module channel at the rear of the receptacle cage and the cavity is open at the front to receive the pluggable module therein for mating with the cabled receptacle connector. A mounting panel extends from the bottom wall. The mounting panel has a mounting surface below the bottom wall for supporting the bottom wall of the receptacle cage at an elevated position above the mounting surface.

In another embodiment, a receptacle assembly of a communication system is provided including a receptacle cage having a plurality of walls defining a cavity extending between a front and a rear of the receptacle cage. The front is configured to extend through a bezel opening in a bezel. The cavity includes a module channel configured to receive a pluggable module. The plurality of walls include a top wall, a bottom wall, a first side wall extending from the top wall to the bottom wall, and a second side wall extending from the top wall to the bottom wall. The cavity is open at the rear to receive a cabled receptacle connector in the module channel at the rear of the receptacle cage and the cavity is open at the front to receive the pluggable module therein for mating with the cabled receptacle connector. The receptacle assembly includes a gasket at the front of the receptacle cage having a plurality of deflectable spring fingers configured to engage the bezel at the bezel opening. The spring fingers are arranged along the top wall, the bottom wall, the first side wall and the second side wall. A mounting panel extends from the bottom wall. The mounting panel has a mounting surface below the bottom wall for supporting the bottom wall of the receptacle cage at an elevated position above the mounting surface such that the front of the receptacle cage is aligned with and received in the bezel opening of the bezel.

In a further embodiment, a receptacle assembly of a communication system is provided including a receptacle cage having a plurality of walls defining a cavity extending between a front and a rear of the receptacle cage. The cavity includes a module channel configured to receive a pluggable module. The plurality of walls include a top wall, a bottom wall, a first side wall extending from the top wall to the bottom wall, and a second side wall extending from the top wall to the bottom wall. The cavity is open at the rear to receive a cabled receptacle connector in the module channel at the rear of the receptacle cage and the cavity is open at the front to receive the pluggable module therein for mating with the cabled receptacle connector. The receptacle assembly includes a mounting panel extending from the bottom wall having a mounting surface below the bottom wall for supporting the bottom wall of the receptacle cage. The receptacle assembly includes a standoff having a base and a head. The base is configured to be mounted to a substrate and extend upward from the substrate to the head. The head is coupled to the mounting panel and supports the mounting panel at an elevated position above the substrate.

DETAILED DESCRIPTION OF THE INVENTION

Various embodiments described herein include a receptacle cage for a receptacle assembly of a communication system, such as for an input/output (I/O) module. The receptacle cage may be configured for a quad small form-factor pluggable (QSFP), a small form-factor pluggable (SFP), and the like. In various embodiments, the receptacle cage includes an opening positioned at a rear of the receptacle cage to allow for a direct-attached, cabled receptacle connector to be loaded therein at the rear and an opening positioned at a front of the receptacle cage to receive a pluggable module for mating with the corresponding cabled receptacle connector. The cabled receptacle connector is mounted directly to the receptacle cage. The cabled receptacle connectors in the receptacle cage are configured to be mounted directly to another component via the cable rather than being terminated to a host circuit board, as is common with conventional receptacle assemblies, which improves signal loss and improves skew by transmitting the signals via cables versus standard, board mounted receptacle connectors. In various embodiments, the receptacle cage includes a mounting panel at the bottom of the receptacle cage that mounts to a standoff feature, acting as the cage support for positioning the receptacle cage within the communication system. The standoff allows the receptacle cage to be used without the need for a printed circuit board and/or other substrate immediately below the receptacle cage. As such, an area for airflow may be defined below the receptacle cage, such as defined by the area around the standoff.

Figure 1:
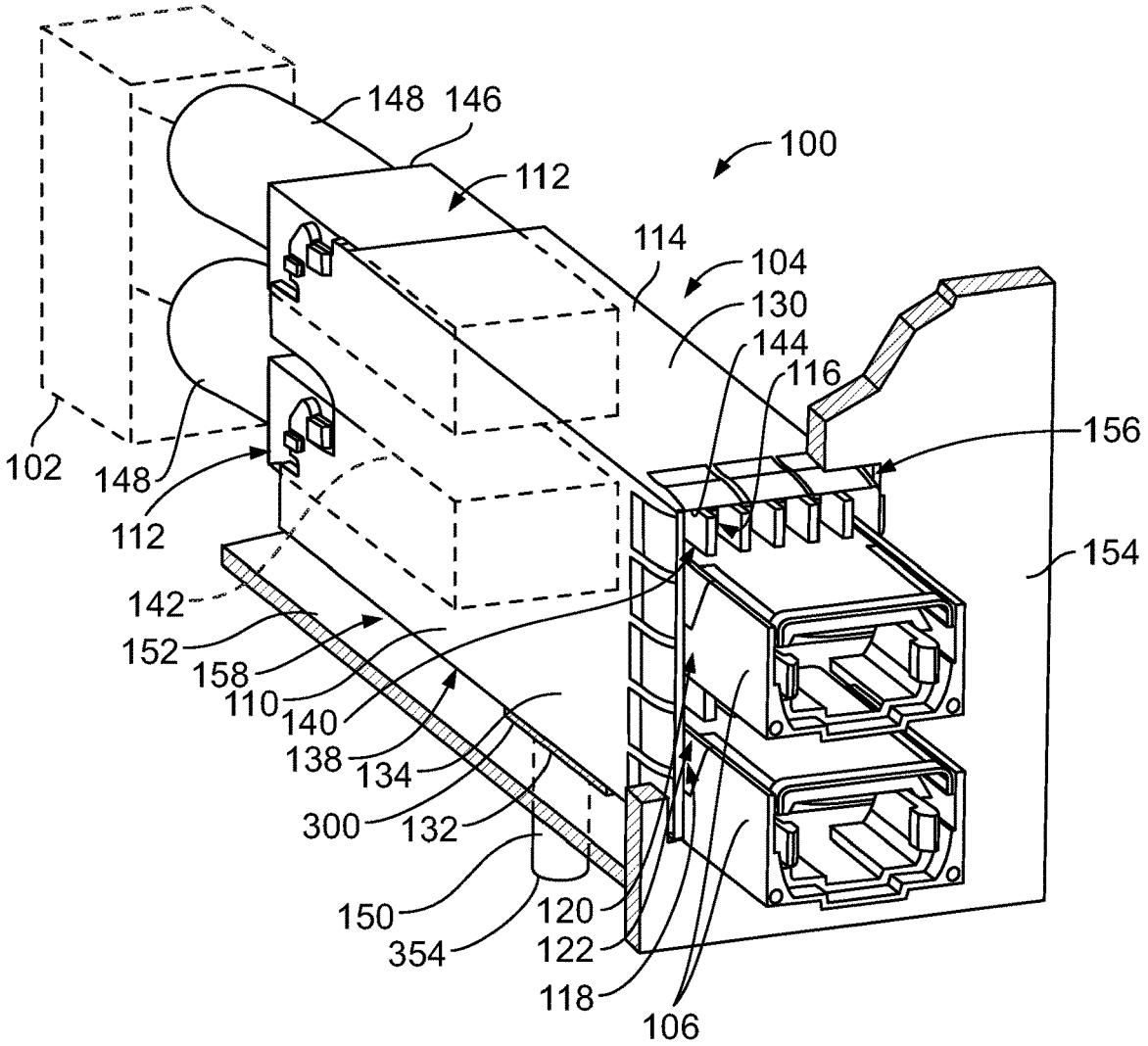
FIG. 1 is a front perspective view of a communication system formed in accordance with an exemplary embodiment.

FIG. 1 is a front perspective view of a communication system 100 formed in accordance with an exemplary embodiment. The communication system 100 includes an electrical component 102 and a receptacle assembly 104 electrically connected to the electrical component 102. In an exemplary embodiment, the receptacle assembly 104 includes a standoff 150 mounted to a substrate 152 to support the receptacle assembly 104. The receptacle assembly 104 is configured to be mounted to a bezel (or panel) 154, such as in a bezel opening 156 in the bezel 154. The bezel 154 surrounds the receptacle assembly 104 and the electrical component 102, such as at a front of the communication system 100. The electrical component 102 may be located remote from the receptacle assembly 104, such as behind the receptacle assembly 104. The receptacle assembly 104 is electrically connected to the electrical component 102 via cables. Pluggable modules 106 are configured to be electrically connected to the receptacle assembly 104, such as from in front of the bezel 154. The pluggable modules 106 are electrically connected to the electrical component 102 through the receptacle assembly 104.

In various embodiments, the electrical component 102 includes an electrical connector. The electrical component 102 may include a circuit board. In various embodiments, rather than being located behind the receptacle assembly 104, the electrical component 102 may be located below the receptacle assembly 104. For example, the substrate 152 may form part of the electrical component 102 and the receptacle assembly 104 is mounted to the substrate 152 of the electrical component 102 using the standoff 150. While the receptacle assembly 104 may be physically mounted to the electrical component 102, the signals of the receptacle assembly 104 are electrically connected to the electrical component 102 via the cables rather than a direct, board mounted electrical connection.

In an exemplary embodiment, the receptacle assembly 104 includes a receptacle cage 110 and one or more cabled receptacle connectors 112 received in the receptacle cage 110 for mating with the corresponding pluggable modules 106. Optionally, a portion of the cabled receptacle connector 112 may extend from and be located rearward of the receptacle cage 110. In various embodiments, the receptacle cage 110 is enclosed and provides electrical shielding for the cabled receptacle connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110.

In the illustrated embodiment, the receptacle cage 110 constitutes a stacked cage member having an upper module channel 116 and a lower module channel 118. The upper module channel 116 receives an upper cabled receptacle connector 112 therein. The lower module channel 118 receives a lower cabled receptacle connector 112 therein. The receptacle cage 110 has upper and lower module ports 120, 122 that open to the module channels 116, 118 that receive corresponding upper and lower pluggable modules 106. Any number of module channels may be provided in various embodiments. In the illustrated embodiment, the receptacle cage 110 includes the upper and lower module channels 116, 118 arranged in a single column, however, the receptacle cage 110 may include multiple columns of ganged module channels 116, 118 in alternative embodiments (for example, 2×2, 3×2, 4×2, 4×3, etc.). The upper and lower cabled receptacle connectors 112 are separately loaded into and unloaded from the module channels 116, 118.

In an exemplary embodiment, the walls 114 of the receptacle cage 110 include a top wall 130, a bottom wall 132, a first sidewall 134 and a second sidewall 136. The first and second sidewalls 134, 136 (shown in FIG. 3) extend from the top wall 130 to a bottom 138 of the receptacle cage 110, such as to the bottom wall 132. The bottom wall 132 is mounted to the standoff 150. The bottom wall 132 is elevated a distance above the substrate 152 by the standoff 150, thus defining a gap 158 below the bottom wall 132, such as for airflow. Optionally, the walls 114 of the receptacle cage 110 may include a rear wall and/or a front wall.

The walls 114 define a cavity 140. For example, the cavity 140 may be defined by the top wall 130, the bottom wall 132, and the sidewalls 134, 136. Other walls 114 may separate or divide the cavity 140 into the various module channels 116, 118. For example, the walls 114 may include a divider wall 142 between the upper and lower module channels 116, 118.

The divider wall 142 may be formed from one or more divider panels between the upper and lower module channels 116, 118. The divider panels may form a space between the upper and lower module channels 116, 118, such as for airflow, for a heat sink, for routing light pipes, or for other purposes.

In an exemplary embodiment, the receptacle cage 110 may include one or more gaskets at a front 144 for providing electrical shielding for the module channels 116, 118. For example, the gaskets may be configured to electrically connect with the pluggable modules 106 received in the corresponding module channels 116, 118. The gaskets may be provided at the module ports 120, 122. The gaskets may be configured to electrically connect with the bezel 154 at the front 144. For example, the gasket may be received in the bezel opening 156 of the bezel 154 and the gasket may electrically connect to the bezel 154 within the bezel opening 156.

In an exemplary embodiment, the receptacle assembly 104 may include one or more heat sinks (not shown) for dissipating heat from the pluggable modules 106. For example, the heat sink may be coupled to the top wall 130 for engaging the upper pluggable module 106 received in the upper module channel 116. The heat sink may extend through an opening in the top wall 130 to directly engage the pluggable module 106. Other types of heat sinks may be provided in alternative embodiments. Optionally, the receptacle assembly 104 may include one or more heat sinks for engaging the lower pluggable module 106 in the lower module channel 118. For example, the lower heat sink may be provided in the divider wall 142 between the upper and lower module channels 116, 118 or may be provided below the bottom wall 132.

In an exemplary embodiment, the cabled receptacle connectors 112 are received in the cavity 140, such as at a rear 146 of the receptacle cage 110. The cabled receptacle connectors 112 may be loaded into the cavity 140 and removable from the cavity 140 through the rear 146. Alternatively, the rear 146 may be closed behind the cabled receptacle connectors 112 such that the cabled receptacle connectors 112 is not removable from the cavity 140 through the rear 146. The cabled receptacle connector(s) 112 are positioned in the cavity 140 to interface with the pluggable module(s) 106 when loaded therein. In an exemplary embodiment, each cabled receptacle connector 112 is used to electrically connect with the pluggable module 106 in the corresponding upper and lower module channels 116, 118.

In an exemplary embodiment, the pluggable modules 106 are loaded through the front 144 to mate with the cabled receptacle connector 112. The shielding walls 114 of the receptacle cage 110 provide electrical shielding around the cabled receptacle connector 112 and the pluggable modules 106, such as around the mating interfaces between the cabled receptacle connector 112 and the pluggable modules 106. The cabled receptacle connector 112 is electrically connected to the electrical component 102 via cables 148 extending rearward from the cabled receptacle connector 112. The cables 148 are routed to the electrical component 102, such as behind the receptacle cage 110 and/or below the receptacle cage 110.

Figure 6:
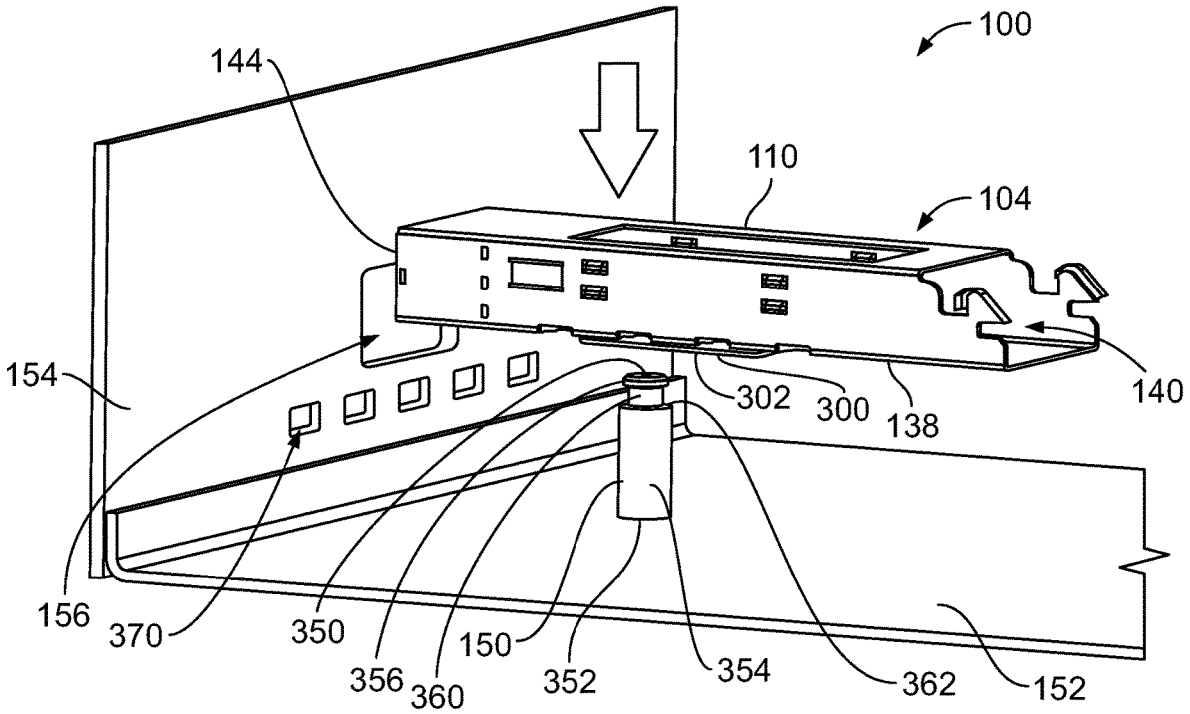
FIG. 6 is a rear perspective view of the receptacle assembly in accordance with an exemplary embodiment showing the receptacle cage poised for loading onto a standoff.

The standoff 150 extends between a top 350 and the bottom 352 (shown, for example, in FIG. 6). The top 350 is configured to support the receptacle cage 110. The bottom 352 is configured to be mounted to the substrate 152. In an exemplary embodiment, the standoff 150 includes a base 354 at the bottom 352 and a head 356 at the top 350. The base 354 is configured to be mounted to the substrate 152 and extend upward from the substrate 152 to the head 356. The head 356 is configured to be coupled to the receptacle cage 110, such as to a mounting panel 300 at the bottom 138 of the receptacle cage 110.

In an exemplary embodiment, the standoff 150 includes a mounting post 360 between the base 354 and the head 356. The mounting post 360 has a smaller diameter than the base 354 and the head 356. In an exemplary embodiment, the standoff 150 includes a support surface 362 at the top of the base 354. The support surface 362 supports the mounting panel 300. The support surface 362 may be defined by a shoulder or ledge between the base 354 and the mounting post 360. The support surface 362 may be perpendicular to the central axis of the standoff 150. For example, the standoff 150 may extend vertically and the support surface 362 may be a horizontal surface. The support surface 362 supports the mounting panel 300 at an elevated position above the substrate 152.

Figure 2:
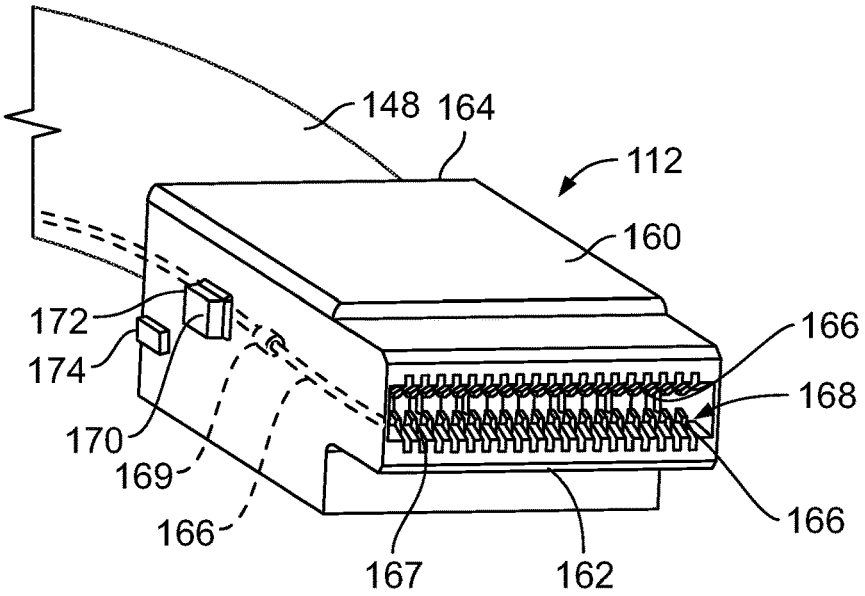
FIG. 2 is a front perspective view of a cabled receptacle connector of the communication system in accordance with an exemplary embodiment.

FIG. 2 is a front perspective view of the cabled receptacle connector 112 in accordance with an exemplary embodiment. The cabled receptacle connector 112 includes a housing 160 having a mating end 162 and a cable end 164. The housing 160 holds contacts 166 (shown in phantom) configured to be electrically connected to the pluggable module 106. The contacts 166 are electrically connected to the cable 148. In an exemplary embodiment, the housing 160 has a card slot 168 at the mating end 162. The card slot 168 is configured to receive a portion of the pluggable module 106 for electrically connecting the cabled receptacle connector 112 to the pluggable module 106. The contacts 166 are provided at the card slot 168 for interfacing with the pluggable module 106.

In an exemplary embodiment, each contact 166 extends between a mating end 167 and a terminating end 169. The mating end 167 is provided at the card slot 168 for mating with the pluggable module 106. The terminating end 169 is terminated to the cable 148, such as to a wire of the cable 148. The wire may be soldered to the terminating end 169 or may be terminated by other means, such as a crimp connection, an insulation displacement connection, or another type of termination. The contacts 166 may be signal contacts, ground contacts, power contacts or other types of contacts.

In an exemplary embodiment, the housing 160 includes latches 170 for securing the cabled receptacle connector 112 to the receptacle cage 110. Each latch 170 includes a latching surface 172 configured to latchably engage the receptacle cage 110. In the illustrated embodiment, the latches 170 are posts or ribs extending from the opposite sides of the housing 160. Other types of latches 170 may be used in alternative embodiments. For example, the latches 170 may include clips or fasteners in other various embodiments. Optionally, the latches 170 may be deflectable latches.

In an exemplary embodiment, the housing 160 includes alignment features 174 for aligning the cabled receptacle connector 112 to the receptacle cage 110. In the illustrated embodiment, the alignment features 174 are tabs extending from the opposite sides of the housing 160. Other types of alignment features 174 may be used in alternative embodiments. For example, the alignment features may be slots or channels formed in the housing 160. The alignment features 174 may be provided on other surfaces of the housing 160 in alternative embodiments.

Figure 3:
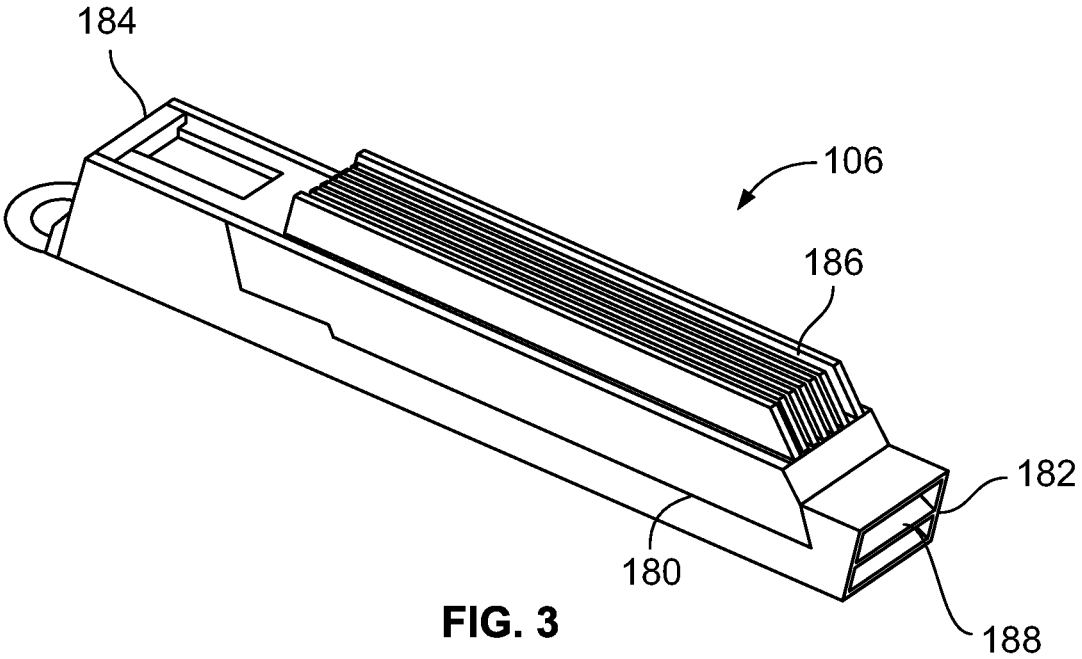
FIG. 3 is a rear perspective view of a pluggable module of the communication system in accordance with an exemplary embodiment.

FIG. 3 is a rear perspective view of the pluggable module 106 in accordance with an exemplary embodiment. The pluggable module 106 has a pluggable body 180, which may be defined by one or more shells. The pluggable body may be thermally conductive and/or may be electrically conductive, such as to provide EMI shielding for the pluggable module 106. The pluggable body 180 includes a mating end 182 and an opposite front end 184. The mating end 182 is configured to be inserted into the corresponding module channel 116 or 118 (shown in FIG. 1). The front end 184 may be a cable end having a cable extending therefrom to another component within the system.

The pluggable module 106 includes a module circuit board 188 that is configured to be communicatively coupled to the cabled receptacle connector 112 (shown in FIG. 1). The module circuit board 188 may be accessible at the mating end 182. The module circuit board 188 may include components, circuits and the like used for operating and or using the pluggable module 106. For example, the module circuit board 188 may have conductors, traces, pads, electronics, sensors, controllers, switches, inputs, outputs, and the like associated with the module circuit board 188, which may be mounted to the module circuit board 188, to form various circuits.

The pluggable module 106 includes an outer perimeter defining an exterior 194 of the pluggable body 180. The exterior 194 extends between the mating end 182 and the front end 184 of the pluggable module 106. In an exemplary embodiment, the pluggable body 180 provides heat transfer for the module circuit board 188, such as for the electronic components on the module circuit board 188. For example, the module circuit board 188 is in thermal communication with the pluggable body 180 and the pluggable body 180 transfers heat from the module circuit board 188. In an exemplary embodiment, the pluggable body 180 includes a plurality of heat transfer fins 186 along at least a portion of the outer perimeter of the pluggable module 106. The fins 186 transfer heat away from the main shell of the pluggable body 180, and thus from the module circuit board 188 and associated components. The fins 186 are separated by gaps that allow airflow or other cooling flow along the surfaces of the fins 186 to dissipate the heat therefrom. In the illustrated embodiment, the fins 186 are parallel plates that extend lengthwise; however the fins 186 may have other shapes in alternative embodiments, such as cylindrical or other shaped posts.

Figure 4:
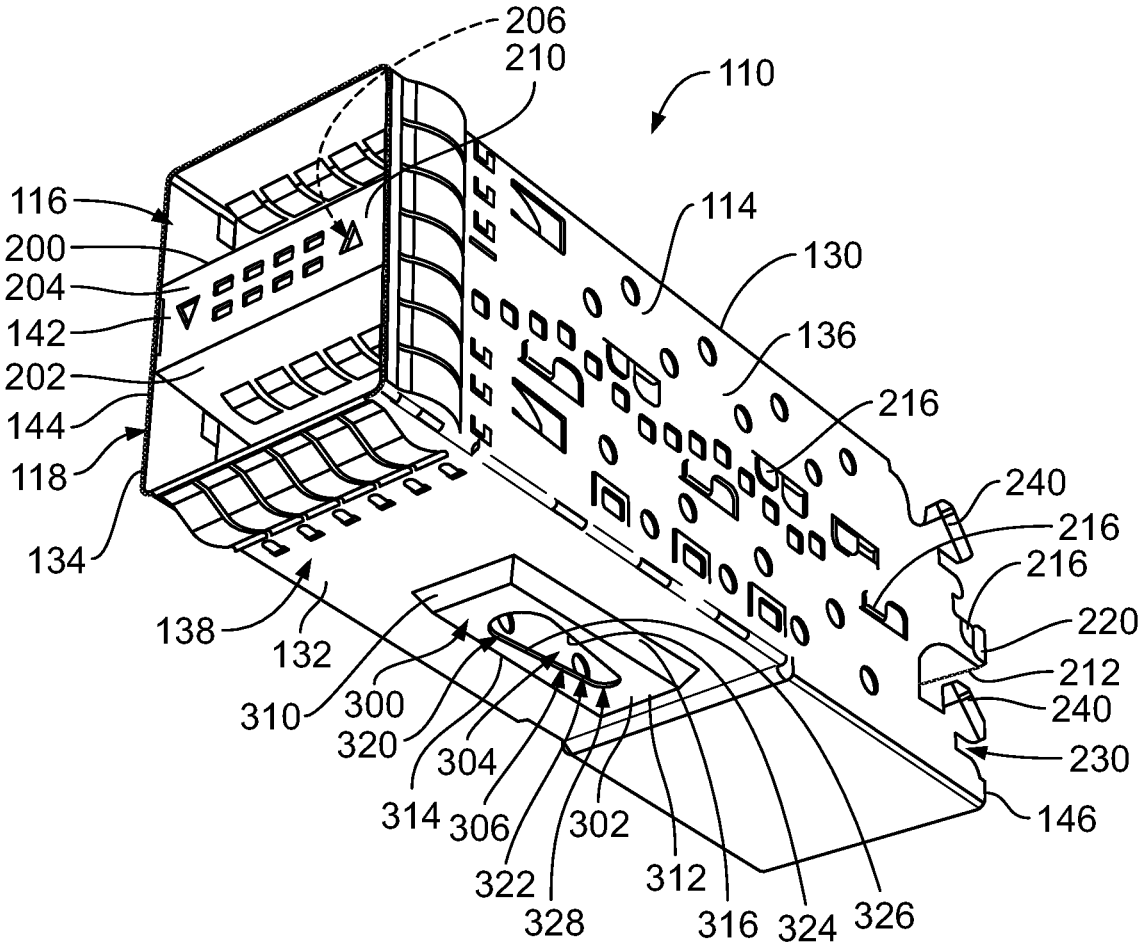
FIG. 4 is a front perspective view of a receptacle cage of the communication system in accordance with an exemplary embodiment.
Figure 5:
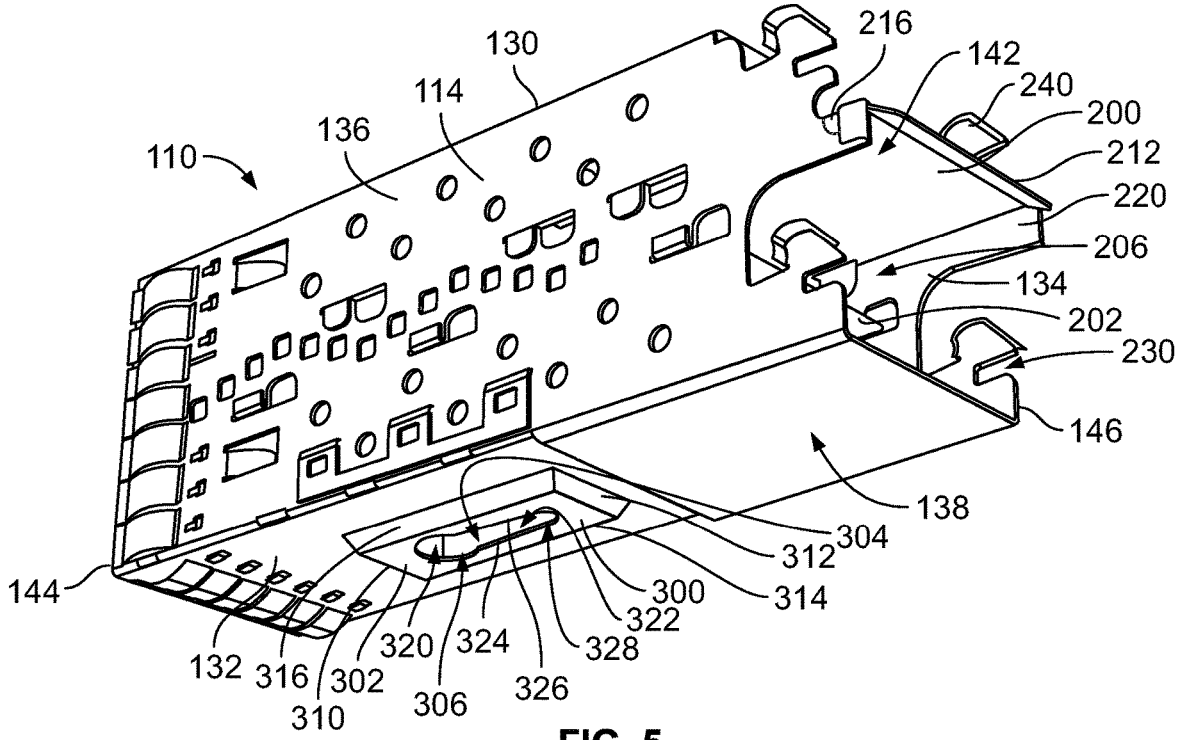
FIG. 5 is a rear perspective view of the receptacle cage in accordance with an exemplary embodiment.

FIG. 4 is a front perspective view of the receptacle cage 110 in accordance with an exemplary embodiment. FIG. 5 is a rear perspective view of the receptacle cage 110 in accordance with an exemplary embodiment. The receptacle cage 110 includes the divider wall 142 between the upper and lower module channels 116, 118. The divider wall 142 separates the upper module channel 116 from the lower module channel 118. In an exemplary embodiment, the divider wall 142 includes an upper divider panel 200, a lower divider panel 202 and a front panel 204 between the upper divider panel 200 and the lower divider panel 202. The divider wall 142 includes a space 206 between the upper divider panel 200 and the lower divider panel 202. In other various embodiments, the divider wall 142 may be formed from a single panel between the upper and lower module channels 116, 118 rather than the upper and lower divider panels 200, 202.

The divider wall 142 extends between a front 210 (FIG. 4) and a rear 212 (FIG. 5). The front 210 of the divider wall is configured to be located at or proximate to the front 144 of the receptacle cage 110. The rear 212 of the divider wall is configured to be located at or proximate to the rear 146 of the receptacle cage 110. In an exemplary embodiment, the upper and lower divider panels 200, 202 extend parallel to the top wall 130 and the bottom wall 132. The upper module channel 116 is defined between the top wall 130 and the upper divider panel 200. The lower module channel 118 is defined between the bottom wall 132 and the lower divider panel 202.

The divider wall 142 is configured to separate and provide electrical shielding between the upper cabled receptacle connector 112 (e.g., within the upper module channel 116) and the lower cabled receptacle connector 112 (e.g., within the lower module channel 118). The divider wall 142 is configured to separate and provide electrical shielding between the upper pluggable module 106 and the lower pluggable module 106.

The divider wall 142 includes mounting fingers 216 for mounting the divider wall 142 to the walls 114 of the receptacle cage 110. For example, the mounting fingers 216 may be coupled to the first and second sidewalls 134, 136. The mounting fingers 216 may be received in pockets or grooves formed in the first and second sidewalls 134, 136.

In an exemplary embodiment, the sidewalls 134, 136 include support arms 220 at or proximate to the rear 146 of the receptacle cage 110. The support arms 220 support the mounting fingers 216. The sidewalls 134, 136 include alignment features 230 for aligning the cabled receptacle connectors 112 in the upper and lower module channels 116, 118. In the illustrated embodiment, the alignment features 230 are defined by alignment slots 230 formed in the sidewalls 134, 136 at the rear 146. The alignment features 230 interface with the alignment features 174 (shown in FIG. 2) of the cabled receptacle connector 112. Other types of alignment features 230 may be provided in alternative embodiments. The sidewalls 134, 136 include latching features 240 for securing the cabled receptacle connectors 112 in the upper and lower module channels 116, 118. The latching features 240 receive the corresponding latches 170 of the cabled receptacle connector 112. In various embodiments, the latches 170 are removably coupled to the latching features 240 such that the cabled receptacle connector 112 may be removed from the receptacle cage 110. In other various embodiments, the cabled receptacle connector 112 may be permanently coupled to or received in the receptacle cage 110, such as using the latches 170 or other features, such as fasteners, clips, assembly process, and the like. For example, the receptacle cage 110 may be closed around the cabled receptacle connector 112 such that the cabled receptacle connector 112 is not removable from the cavity.

The receptacle cage 110 includes a mounting panel 300 extending from the bottom wall 132. The mounting panel 300 is configured to be coupled to the standoff 150. The mounting panel 300 includes a mounting surface 302 below the bottom wall 132 for supporting the bottom wall 132 of the receptacle cage 110 at an elevated position above the mounting surface 302. For example, the mounting surface 302 is configured to be supported by the standoff 150. In an exemplary embodiment, the mounting surface 302 rests on the support surface 362 (shown in FIG. 6) of the standoff 150.

In an exemplary embodiment, the mounting panel 300 forms a pocket 304 between the mounting surface 302 and the bottom wall 132. The pocket 304 is a space below the bottom wall 132 and above the mounting surface 302. The pocket 304 receives a portion of the standoff 150. For example, the pocket 304 receives the head 356 (shown in FIG. 1) of the standoff 150. The pocket 304 is recessed below the bottom wall 132 such that the head 356 is able to be positioned below the cavity and thus not interfere with loading and unloading of the pluggable module 106. In an exemplary embodiment, the mounting panel 300 includes a mounting slot 306 that receives the standoff 150. For example, the mounting slot 306 receives the mounting post 360 (shown in FIG. 1) of the standoff 150. The mounting slot 306 positions the standoff 150 relative to the mounting panel 300.

In an exemplary embodiment, the mounting panel 300 includes a front wall 310 and a rear wall 312. The mounting panel 300 includes a lower wall 314 extending between the front wall 310 and the rear wall 312. Optionally, the mounting panel 300 includes sidewalls 316 extending between the front wall 310 and the rear wall 312. The front wall 310, the rear wall 312 and the sidewalls 316 extend from the bottom wall 132. The front wall 310, the rear wall 312 and the sidewalls 316 connect the mounting panel 300 to the bottom wall 132. In an exemplary embodiment, the mounting panel 300 is an integral, unitary monolithic body with the bottom wall 132. For example, the front wall 310, the rear wall 312, the sidewalls 316 and the lower wall 314 are stamped and formed from the bottom wall 132. In an exemplary embodiment, the lower wall 314 defines the mounting surface 302. The lower wall 314 may be parallel to and spaced apart from and located below the bottom wall 132.

The pocket 304 is defined between the lower wall 314 and the bottom wall 132 and receives a portion of the standoff 150. The mounting slot 306 is formed in the lower wall 314 and receives a portion of the standoff 150. In an exemplary embodiment, the mounting slot 306 includes a front opening 320 and a rear opening 322 extending rearward from the front opening 320. Optionally, the front opening 320 is larger than the rear opening 322, such as to receive the head 356 (shown in FIG. 6) of the standoff 150. The front opening 320 is configured to initially receive the standoff 150 and the rear opening 322 receives the standoff as the receptacle cage 110 is slid forward. Optionally, the front opening 320 may be circular in the rear opening 322 may be an elongated slot. Optionally, the rear opening 322 may be tapered inward from front to rear. For example, the mounting slot 306 may include a first edge 324 and a second edge 326. The first and second edges 324, 326 may be nonparallel and tapered inward from front to rear. Optionally, the rear opening 322 may include a detent 328 at the rear thereof for clipping the standoff 150 to the mounting post 360 and holding the mounting panel 300 on the standoff 150.

Figure 7:
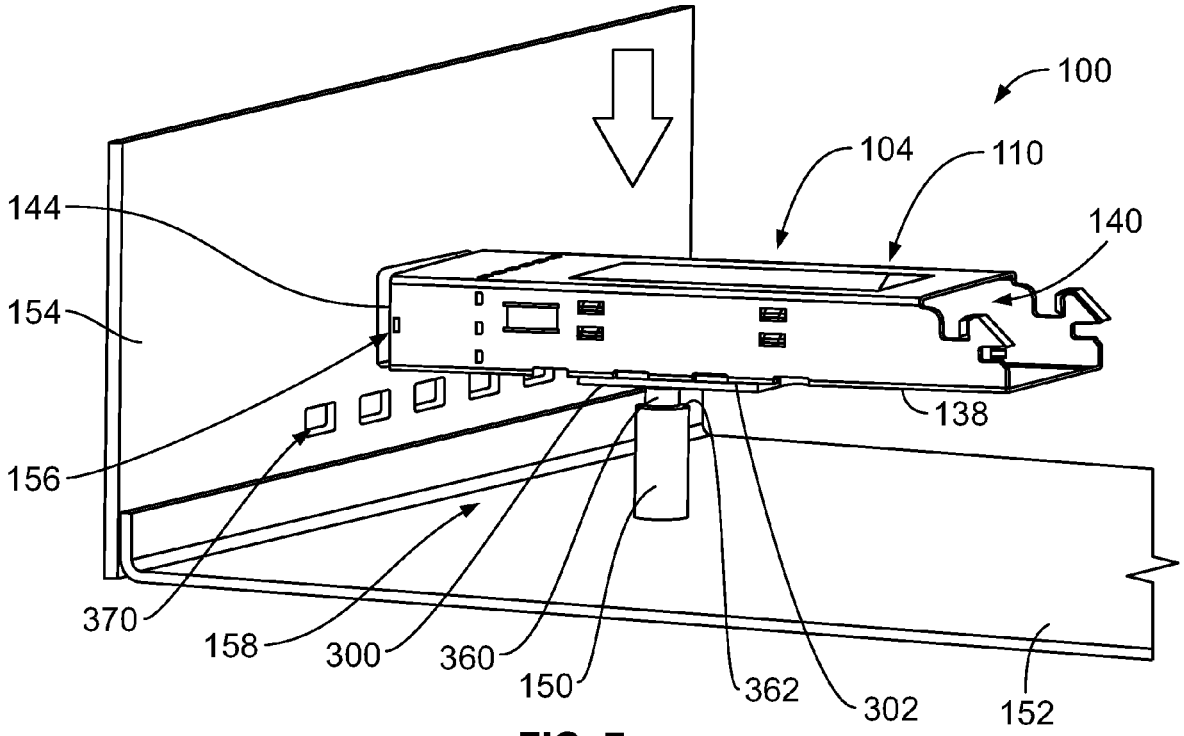
FIG. 7 is a rear perspective view of the receptacle assembly showing the receptacle cage in a supported position on the standoff.
Figure 8:
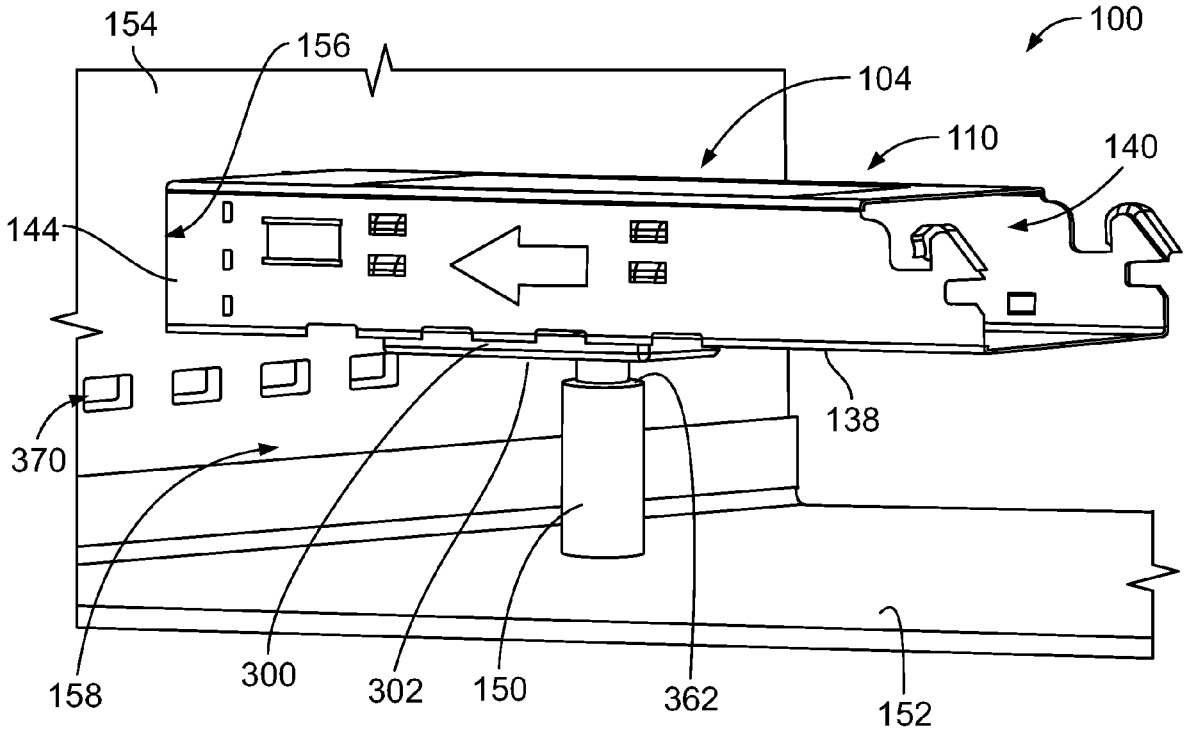
FIG. 8 is a rear perspective view of the receptacle assembly showing the receptacle cage in a mated position with a bezel.

FIG. 6 is a rear perspective view of the receptacle assembly 104 in accordance with an exemplary embodiment showing the receptacle cage 110 as a single module channel cage rather than a stacked cage. The receptacle cage 110 is shown poised for loading to the standoff 150 and the bezel 154. FIG. 7 is a rear perspective view of the receptacle assembly 104 showing the receptacle cage 110 in a supported position. FIG. 8 is a rear perspective view of the receptacle assembly 104 showing the receptacle cage 110 in a mated position. In an exemplary embodiment, the receptacle cage 110 is loaded onto the standoff 150 in a vertical direction from above the standoff 150 to the supported position and is then shifted forward to the mated position.

During assembly, the mounting panel 300 is mounted to the top 350 of the standoff 150. For example, the head 356 is configured to be loaded into the mounting slot 306 (shown in FIG. 5), such as into the front opening 320. When the receptacle cage 110 is loaded onto the standoff 150, the mounting surface 302 of the mounting panel 300 is supported on the support surface 362 of the standoff 150. The head 356 is received in the pocket 304 of the mounting panel 300. The mounting post 360 is located in the mounting slot 306. In the supported position (FIG. 7), the front 144 of the receptacle cage 110 is aligned with the bezel opening 156 of the bezel 154. From the supported position, the receptacle cage 110 may be shifted forward to the mated position (FIG. 8) to load the front 144 of the receptacle cage 110 into the bezel opening 156. In the mated position, the receptacle cage 110 is supported at the front 144 by the bezel 154 and along the bottom 138 by the standoff 150. Having the two points of support leaves other areas of the receptacle cage 110 open and unobstructed to allow air flow around the receptacle cage 110.

In an exemplary embodiment, when assembled, the standoff 150 supports the receptacle cage 110 at an elevated positioned above the substrate 152. Optionally, the gap 158 below the receptacle cage 110 may be open to allow airflow below the receptacle cage 110, such as for cooling the pluggable module 106 and/or the cabled receptacle connector 112 in the cavity 140 of the receptacle cage 110. Optionally, the bezel 154 may include airflow openings 370 in flow communication with the gap 158 to enhance airflow below the receptacle cage 110. For example, air may flow through the bezel 154 through the airflow openings 370 to enhance airflow within the gap 158.

Using the standoff 150 eliminates the need for mounting the receptacle cage 110 directly to a circuit board. In various embodiments, the standoff 150 may eliminate the need for the circuit board altogether and thus illuminates the cost of the circuit board, such as when the substrate 152 is not a circuit board. For example, the substrate 152 may be a piece of sheet metal or another component within the communication system 100. The cabled receptacle connectors 112 are electrically connected to the electrical component 102 via the cables and thus the receptacle assembly 104 does not need to be electrically connected to a circuit board below the receptacle cage 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle assembly of a communication system comprising:

a receptacle cage having a plurality of walls defining a cavity extending between a front and a rear of the receptacle cage, the cavity including a module channel configured to receive a pluggable module, the plurality of walls including a top wall, a bottom wall, a first side wall extending from the top wall to the bottom wall, and a second side wall extending from the top wall to the bottom wall, the first side wall extending to a bottom edge, the second side wall extending to a bottom edge, wherein the cavity receives a cabled receptacle connector in the module channel at the rear of the receptacle cage and the cavity is open at the front to receive the pluggable module therein for mating with the cabled receptacle connector; and a mounting panel extending from the bottom wall, the mounting panel having a mounting surface below the bottom wall and extending below the bottom edges of the first and second side walls for supporting the bottom wall and the first and second side walls of the receptacle cage at an elevated position above the mounting surface.

2. The receptacle assembly of claim 1, wherein the mounting panel forms a pocket between the mounting surface and the bottom wall.

3. The receptacle assembly of claim 1, wherein the mounting panel is an integral, unitary monolithic body with the bottom wall.

4. The receptacle assembly of claim 1, wherein the mounting panel includes a front wall, a lower wall and a rear wall, the lower wall defining the mounting surface, the lower wall being parallel to and spaced apart from and located below the bottom wall, the front wall and the rear wall connecting the lower wall to the bottom wall.

5. The receptacle assembly of claim 1, wherein the mounting panel includes a mounting slot configured to receive a standoff used to support the mounting panel and the receptacle cage.

6. The receptacle assembly of claim 5, wherein the mounting slot includes a first edge and a second edge being non-parallel and tapered inward from front to rear.

7. The receptacle assembly of claim 1, wherein the front of the receptacle cage is configured to be received in a bezel opening in a bezel, the receptacle cage being separately supported only at the front by the bezel and rearward of the front by the mounting panel.

8. The receptacle assembly of claim 7, further comprising a standoff configured to be coupled to a substrate, the standoff being coupled to the mounting panel such that the receptacle cage is only supported by the bezel and the standoff.

9. The receptacle assembly of claim 8, wherein the standoff is aligned with the module channel and configured to be in thermal communication with the pluggable module.

10. The receptacle assembly of claim 1, wherein an airflow gap is defined below the bottom wall by elevating the mounting panel.

11. The receptacle assembly of claim 1, further comprising a gasket at the front of the receptacle cage configured to engage a bezel at a bezel opening, the mounting panel aligning the front of the receptacle cage with the bezel opening such that the front of the receptacle cage passes through the bezel opening to interface the gasket with the bezel.

12. The receptacle assembly of claim 1, wherein the module channel is a lower module channel, the cavity having an upper module channel separated from the lower module channel by a divider panel, the upper module channel configured to receive an upper pluggable module and an upper cabled receptacle connector.

13. A receptacle assembly of a communication system comprising:

a receptacle cage having a plurality of walls defining a cavity extending between a front and a rear of the receptacle cage, the front is configured to extend through a bezel opening in a bezel, the cavity including a module channel configured to receive a pluggable module, the plurality of walls including a top wall, a bottom wall, a first side wall extending from the top wall to the bottom wall, and a second side wall extending from the top wall to the bottom wall, the first side wall extending to a bottom edge, the second side wall extending to a bottom edge, wherein the cavity is open at the rear to receive a cabled receptacle connector in the module channel at the rear of the receptacle cage and the cavity is open at the front to receive the pluggable module therein for mating with the cabled receptacle connector;

a gasket at the front of the receptacle cage, the gasket having a plurality of deflectable spring fingers configured to engage the bezel at the bezel opening, the spring fingers being arranged along the top wall, the bottom wall, the first side wall and the second side wall; and a mounting panel extending from the bottom wall, the mounting panel having a mounting surface below the bottom wall and extending below the bottom edges of the first and second side walls for supporting the bottom wall and the first and second side walls of the receptacle cage at an elevated position above the mounting surface such that the front of the receptacle cage is aligned with and received in the bezel opening of the bezel.

14. The receptacle assembly of claim 13, wherein the mounting panel forms a pocket between the mounting surface and the bottom wall.

15. The receptacle assembly of claim 13, wherein the mounting panel includes a front wall, a lower wall and a rear wall, the lower wall defining the mounting surface, the lower wall being parallel to and spaced apart from and located below the bottom wall, the front wall and the rear wall connecting the lower wall to the bottom wall.

16. The receptacle assembly of claim 13, wherein the mounting panel includes a mounting slot configured to receive a mounting post used to support the mounting panel and the receptacle cage.

17. The receptacle assembly of claim 13, further comprising a standoff configured to be coupled to a substrate, the standoff being coupled to the mounting panel such that the receptacle cage is only supported by the bezel and the standoff.

18. A receptacle assembly of a communication system comprising:

a receptacle cage having a plurality of walls defining a cavity extending between a front and a rear of the receptacle cage, the cavity including a module channel configured to receive a pluggable module, the plurality of walls including a top wall, a bottom wall, a first side wall extending from the top wall to the bottom wall, and a second side wall extending from the top wall to the bottom wall, the first side wall extending to a bottom edge, the second side wall extending to a bottom edge, wherein the cavity is open at the rear to receive a cabled receptacle connector in the module channel at the rear of the receptacle cage and the cavity is open at the front to receive the pluggable module therein for mating with the cabled receptacle connector;

a mounting panel extending from the bottom wall, the mounting panel having a mounting surface below the bottom wall and extending below the bottom edges of the first and second side walls for supporting the bottom wall and the first and second side walls of the receptacle cage; and a standoff having a base and a head, the base configured to be mounted to a substrate and extend upward from the substrate to the head, the head being coupled to the mounting panel and supporting the mounting panel at an elevated position above the substrate.

19. The receptacle assembly of claim 18, wherein the mounting panel forms a pocket between the mounting surface and the bottom wall, the pocket receiving the head of the standoff.

20. The receptacle assembly of claim 18, further comprising a gasket at the front of the receptacle cage configured to engage a bezel at a bezel opening, the mounting panel aligning the front of the receptacle cage with the bezel opening such that the front of the receptacle cage passes through the bezel opening to interface the gasket with the bezel.

* * * * *